US009546018B1

(12) United States Patent
Vovan et al.

(10) Patent No.: US 9,546,018 B1
(45) Date of Patent: Jan. 17, 2017

(54) ENHANCED TAMPER-EVIDENT CONTAINER

(71) Applicants: Terry Vovan, Upland, CA (US); Leon Rosen, Santa Monica, CA (US)

(72) Inventors: Terry Vovan, Upland, CA (US); Leon Rosen, Santa Monica, CA (US)

(73) Assignee: SMART-TAB, LLC, Upland, CA (US)

( * ) Notice: Subject to any disclaimer, the term of this patent is extended or adjusted under 35 U.S.C. 154(b) by 0 days.

(21) Appl. No.: 13/960,561

(22) Filed: Aug. 6, 2013

(51) Int. Cl.
*B65D 17/34* (2006.01)
*B65D 17/00* (2006.01)
*B65D 43/02* (2006.01)

(52) U.S. Cl.
CPC ..... *B65D 17/16* (2013.01); *B65D 43/0254* (2013.01); *B65D 2543/0049* (2013.01)

(58) Field of Classification Search
CPC . B65D 43/0254; B65D 43/0258; B65D 17/16; B65D 17/161; B65D 17/163; B65D 17/165; B65D 2543/0049; B21D 51/38; B21D 51/383
USPC ..... 206/807; 215/255, 301, 305, 254, 253, 215/252; 220/203.1, 212.5, 214, 254.1, 254.3, 220/254.5, 264, 270, 713, 789, 791, 793, 266, 220/265, 906; 49/460
See application file for complete search history.

(56) References Cited

U.S. PATENT DOCUMENTS

| | | | | | |
|---|---|---|---|---|---|
| 3,656,648 | A * | 4/1972 | Powaloski et al. | 215/253 |
| 3,690,499 | A * | 9/1972 | Westfall et al. | 215/253 |
| 3,866,782 | A * | 2/1975 | Westfall | 215/253 |
| 4,407,423 | A * | 10/1983 | Walter | 220/260 |
| 4,431,110 | A * | 2/1984 | Roth | 215/213 |
| 4,440,310 | A * | 4/1984 | Heyn | 220/270 |
| 4,462,504 | A * | 7/1984 | Roth et al. | 220/214 |
| 4,496,069 | A * | 1/1985 | Winkless et al. | 220/260 |
| 4,519,517 | A * | 5/1985 | Walter | 215/253 |
| 4,711,372 | A * | 12/1987 | Gach | 222/23 |
| 4,742,935 | A * | 5/1988 | Schellenberg | 220/791 |
| 4,778,072 | A * | 10/1988 | Newman | 215/253 |
| 4,966,301 | A * | 10/1990 | Yamashita et al. | 220/270 |
| 5,511,680 | A * | 4/1996 | Kinne | 206/276 |
| 5,806,710 | A * | 9/1998 | Shiffer et al. | 220/785 |
| 5,931,332 | A * | 8/1999 | Mygatt et al. | 220/270 |
| 6,332,552 | B1 * | 12/2001 | Iwasaki et al. | 220/276 |
| 6,688,486 | B2 * | 2/2004 | Diamond et al. | 220/785 |
| 6,883,678 | B2 * | 4/2005 | Chou | 220/793 |
| 7,631,776 | B2 * | 12/2009 | Vovan et al. | 220/266 |
| 7,870,979 | B2 * | 1/2011 | Maki et al. | 222/570 |
| 8,272,526 | B1 * | 9/2012 | Vovan et al. | 220/270 |
| 2008/0128443 | A1 * | 6/2008 | Coughlin et al. | 220/791 |
| 2008/0290091 | A1 * | 11/2008 | Shiffer et al. | 220/270 |
| 2009/0321463 | A1 * | 12/2009 | Vovan | 220/791 |

* cited by examiner

*Primary Examiner* — James N Smalley
(74) *Attorney, Agent, or Firm* — Juneau & Mitchell; Todd L. Juneau

(57) ABSTRACT

A tamper-evident container has a lid (14) that can be opened only by lifting and pulling a tab (18). Pulling of the tab breaks a breakable joint (41, 43, 70, FIG. 4) that connects the tab (18) to a hold-down (24) that is fixed to the lid, so when the tab is released from the hold-down the tab springs up (FIG. 2) to an upward incline J to indicate that the container was opened.

18 Claims, 13 Drawing Sheets

VIEW B

VIEW D

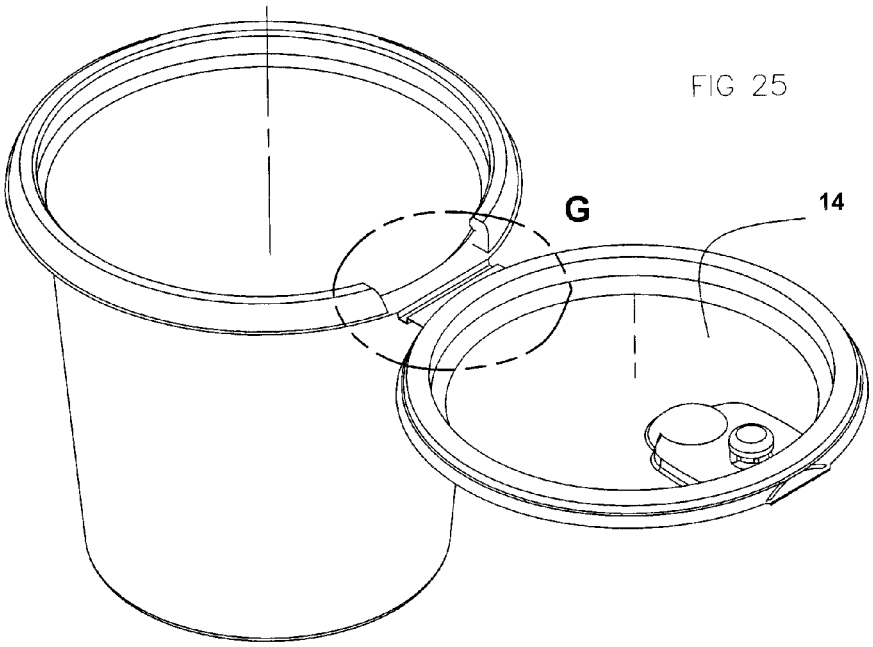
FIG 25
FIG 26
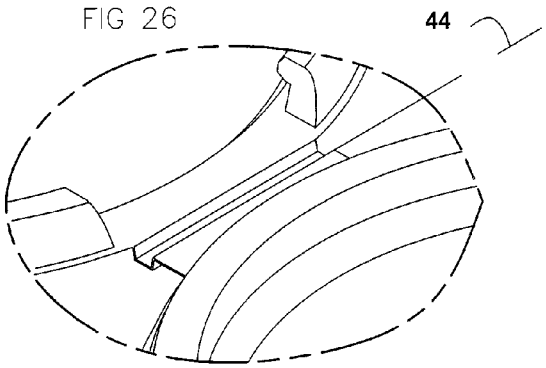
VIEW G
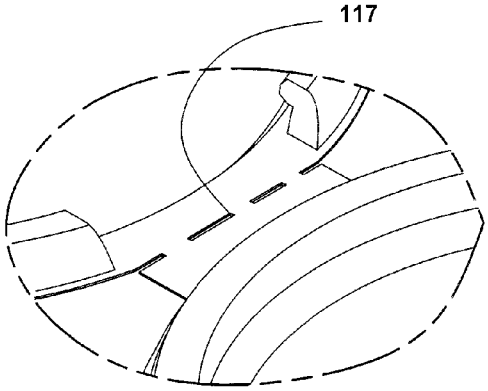
FIG 27

FIG 30
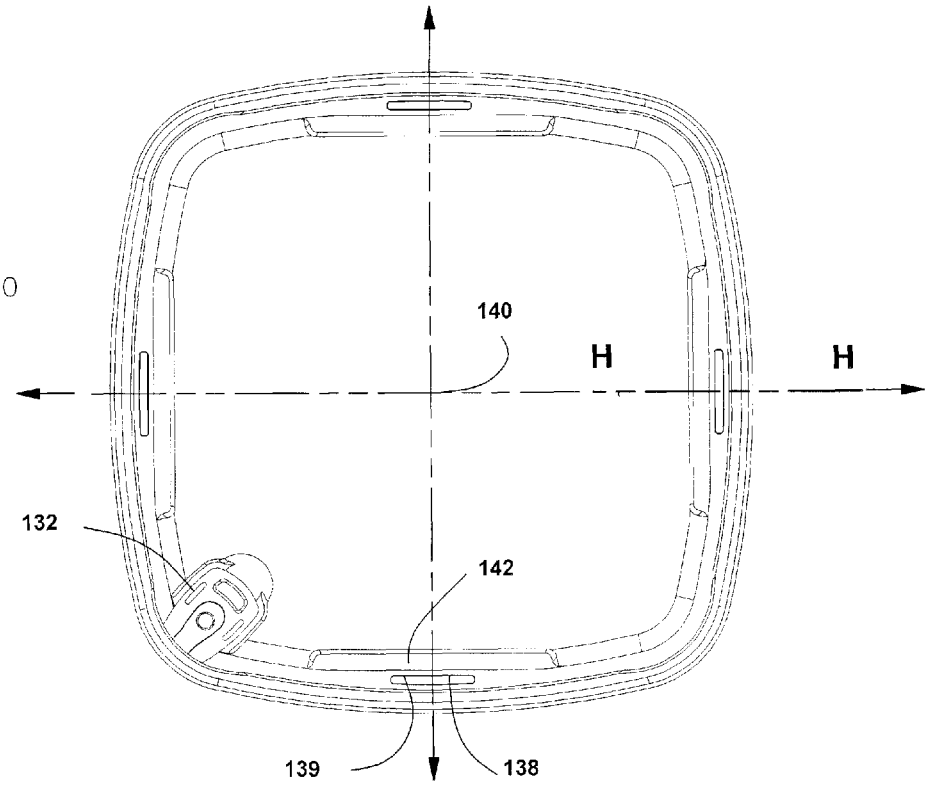
FIG 31
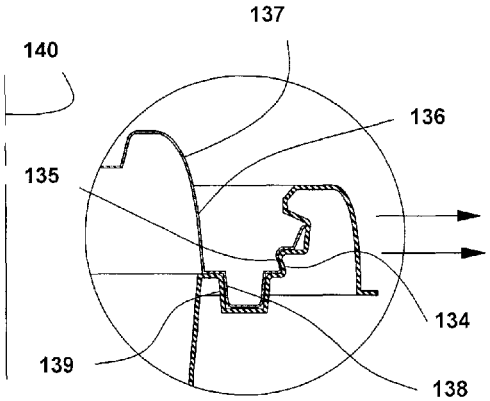
VIEW J
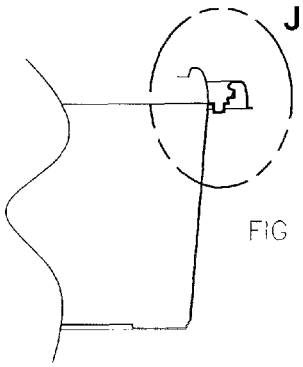
FIG 32
VIEW H

ENHANCED TAMPER-EVIDENT CONTAINER

BACKGROUND OF THE INVENTION

Food is often prepared for sale by a store clerk who loads the food into a base of a plastic container, and closes the lid of the container on the base. A customer is assured that the tamper-evident container has not been opened since the time when a clerk first loaded food into it and first closed it, by constructing a pull-tab that opens the lid so the pull-tab extends at an upward incline after the first time that someone opens the lid, such as to taste a small sample of it. If a customer sees that the pull-tab is raised, then the customer knows that the container has been already tampered with and the food may be contaminated, and if the tab is completely down then the customer knows that the container has not been tampered and therefore that the food has not been contaminated.

SUMMARY OF THE INVENTION

In accordance with one embodiment of the invention, applicant provides a pull-tab assembly that includes a tab for opening a container lid and a hold-down for holding the tab down to the container lid before the lid is first opened. After the first time that the tab was pulled to separate it from the hold-down and to open the lid, the tab remains at an upward incline. The tab is pivotally connected to the edge of the lid and is preformed so the tab tends to remain pivoted up after it was pulled up to open the lid. To assure that the tab will remain at an upward incline of many degrees, a bend arrangement is introduced into the tab. The bend arrangement preferably includes a plurality of bends to assure that the tab tends to pivot up. The plurality of bends are spaced from the edge of the lid for durability.

The hold-down is preferably joined to the tab by a joint that can be torn when the lid is first opened. The torn joint frees the tab so the tab can be pulled to open the container. The hold-down includes a downward protrusion with an enlargement at its lower end. The enlargement is pressed down into an undercut recess in the lid to lock the hold-down in the undercut recess. To prevent tampering, the tab is recessed below the lid upper surface. Applicant forms the joint so it extends closely around the protrusion. Other means for keeping the hold-down in place are also described.

The lid has a lid rim around a periphery of the lid and the base has a base rim around a periphery of the base. The base rim and the lid rim are joined together to seal the lid and base and to protect the lid from being opened, The lid is held down to the base of the container by forming the base rim with a vertical wall that has an upper end that forms an inside corner with a wall above it. The vertical wall has a lower end that is joined at a lower inside corner to a lower horizontal wall. The lid has a skirt that extends up against the upper inside corner to lock the lid in place and protect it by a perimeter fence.

The novel features of the invention are set forth with particularity in the appended claims. The invention will be best understood from the following description when read in conjunction with the accompanying drawings.

BRIEF DESCRIPTION OF THE DRAWINGS

FIGS. 25-27 are isometric views of various hinged containers that utilize the pull-tab.

FIG. 30 is a plan view of the rectangular container of FIG. 29 which has an interference fit lock of the lid and the container between the corners.

FIG. 31 is a sectional view of the right side of FIG. 32, which shows the interference fit of the lid and the container.

FIG. 32 is a sectional view of the right side of FIG. 30.

DESCRIPTION OF THE PREFERRED EMBODIMENTS

Figure 1:
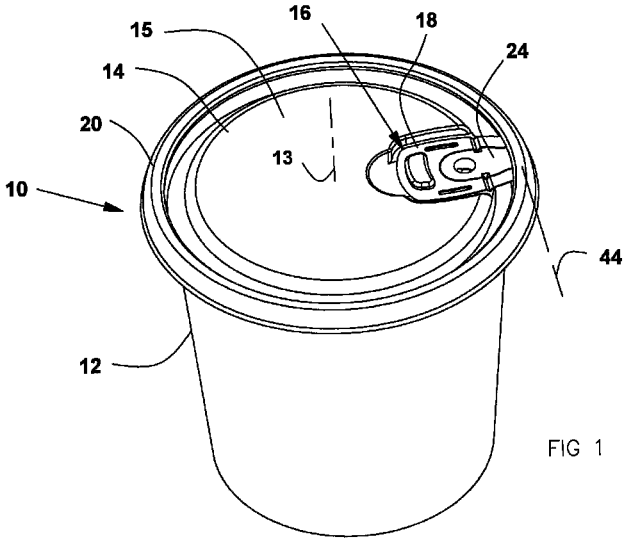
FIG. 1 is an isometric view of a container of the invention with the pull-tab in its closed and stowed position.
Figure 4:
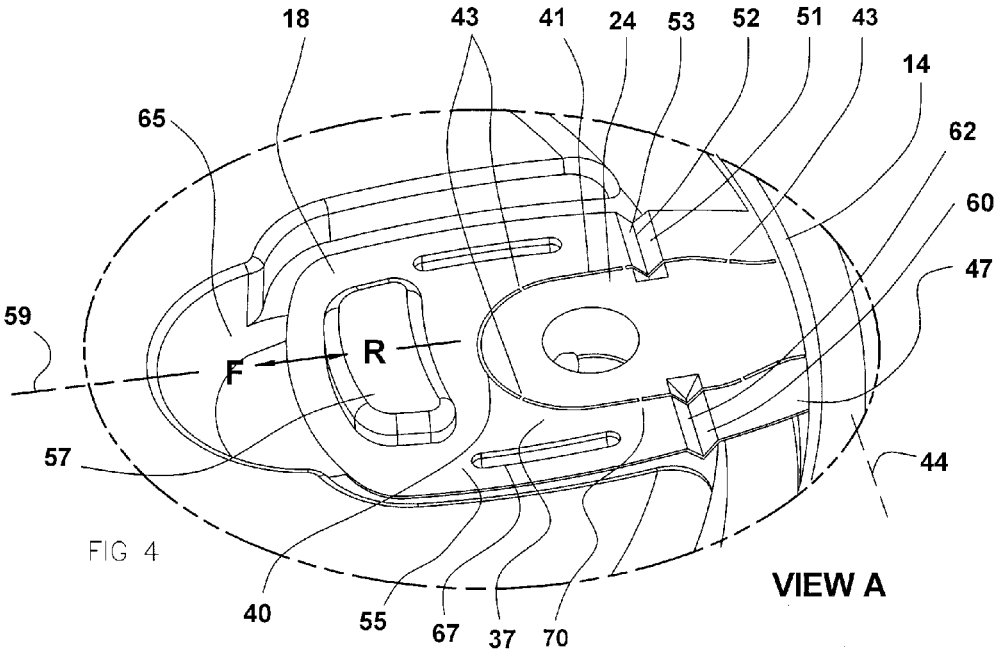
FIG. 4 is an enlarged view of area A of FIG. 1.
Figure 5:
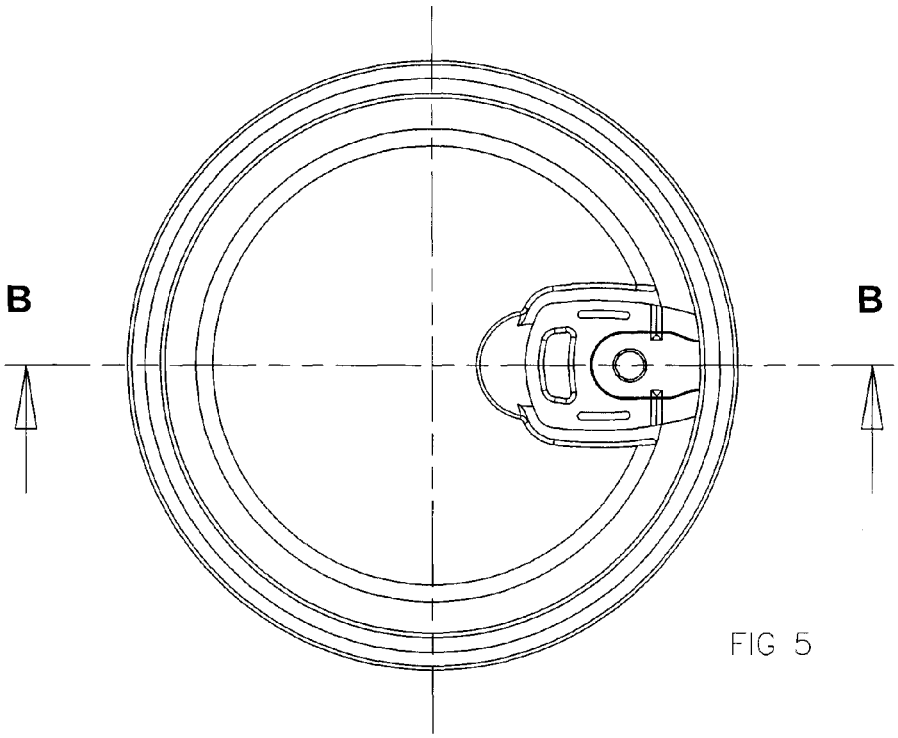
FIG. 5 is a plan view of the container of FIG. 1.
Figure 6:
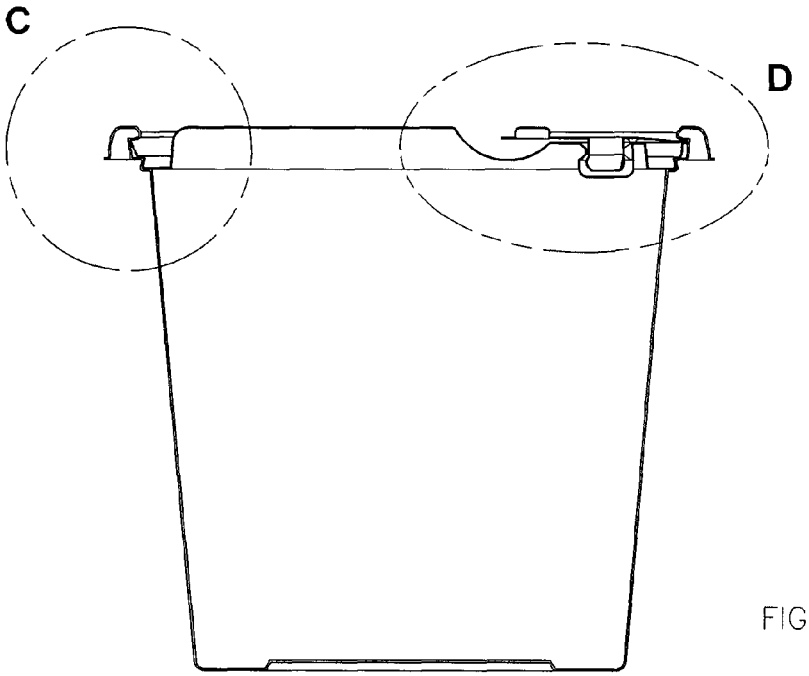
FIG. 6 is a sectional view taken on line B-B of FIG. 5.
Figure 10:
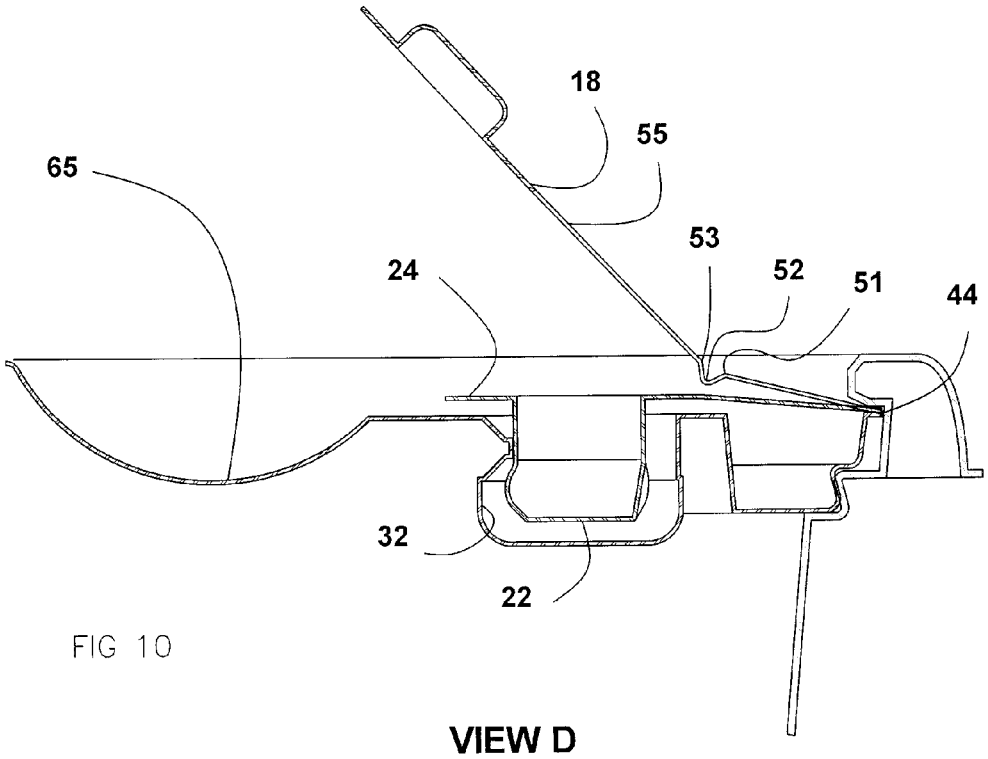
FIG. 10 is an enlarged sectional view of FIG. 9 after the first time the tab has been lifted.
Figure 11:
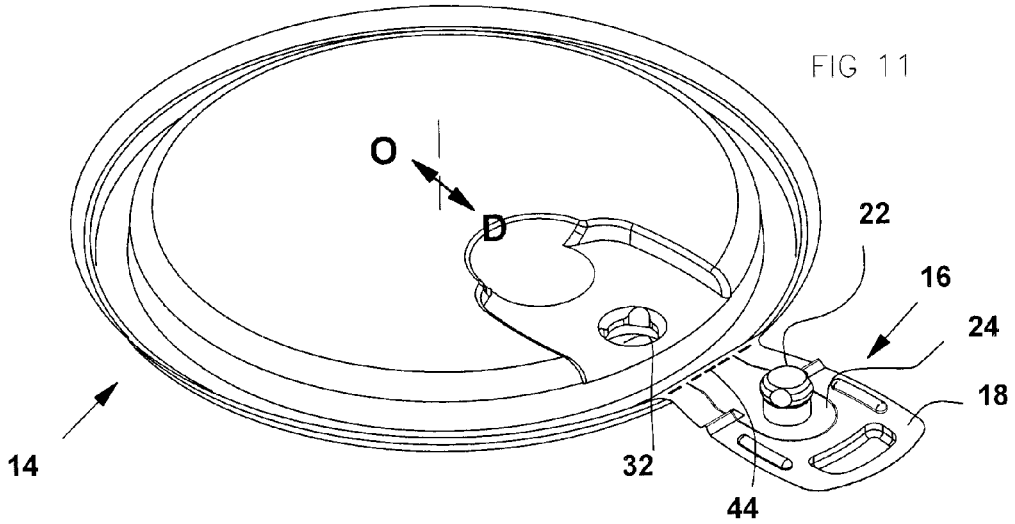
FIG. 11 is an isometric view of the lid of the container of FIG. 1, prior to closing the tab on the container lid.
Figure 12:
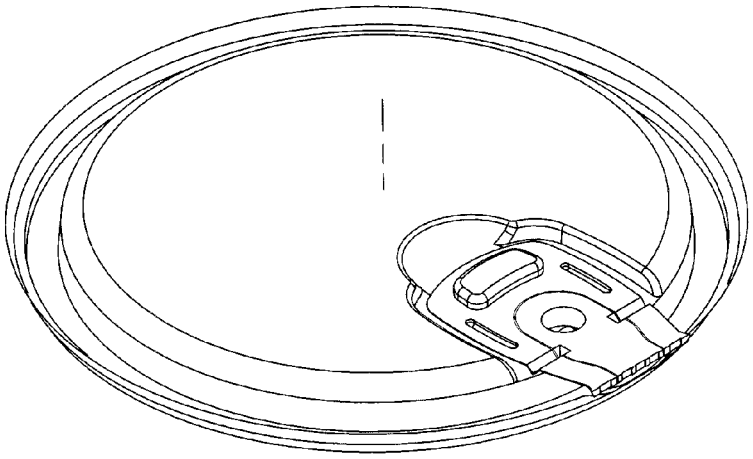
FIG. 12 is a view of FIG. 11 after closing the tab.
Figure 13:
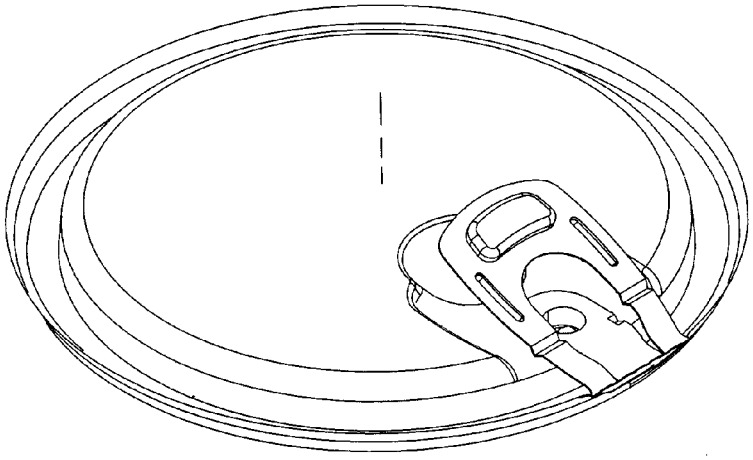
FIG. 13 is a view of FIG. 12 after the tab has broken free of the hold-down and has pivoted to an upward incline.

FIG. 1 shows a container 10 that has a tapered cylindrical base 12 with a vertical axis 13 for holding goods, especially food, and a lid 14 that covers the base. The base 12 and the lid 14 can be formed from different thicknesses of plastic sheets. The lid 14 has a flat stacking surface 15 and a recessed pull-tab assembly 16 which includes a tab 18 and a hold-down 24 attached to the lid. The entire pull-tab assembly 16 lies recessed below the lid stacking surface 15 to allow stacking of the containers. The lid 14 and the pull-tab assembly 16 are formed integrally and have the same thickness of plastic sheet. A clerk in a store will typically load food in the base 12 and then push the lid 14 down against the top of the base 12 so a rim portion 20 of the lid 14 latches to the base 12. As shown in FIG. 11, the hold-down 24 of the tab assembly 16 includes an enlargement 22 which has been pushed into an undercut recess 32 on the lid 14, to lock down the pull-tab assembly 16 to the lid 14. The tab 18 of the pull-tab assembly 16 pivots at the a hinge 42 which defines a hinge axis 44 and remains in the position shown in FIG. 1 to keep the lid 14 closed, until the first time the container 10 is opened. The container 10 of FIG. 1 is opened by pulling up on the tab 18 to pull open the lid 14. A person inserts his finger into a lid recess 65 to grasp the finger grip 57 of the tab 18. When the tab 18 is pulled up, the tab breaks breakable joints 43 and 70 (FIG. 4) where the tab 18 is connected to the hold-down 24 so one part 37 of the tab is detached from the hold-down 24. FIG. 4 shows that there is a through precut channel 40 between the tab 18 and the hold- down 24 that extends to a rear tab location 47 that lies adjacent to the hinge 42 (hidden in FIG. 4 but seen in FIGS. 10 and 11) and the hinge axis 44 with the cut interrupted by a few connections (also called breakable joints) 43 that can be broken, and that form the joint connecting the tab 18 and hold-down 24. The rear location 47 of the tab 18 remains attached to the lid 14 at the hinge 42.

Figure 2:
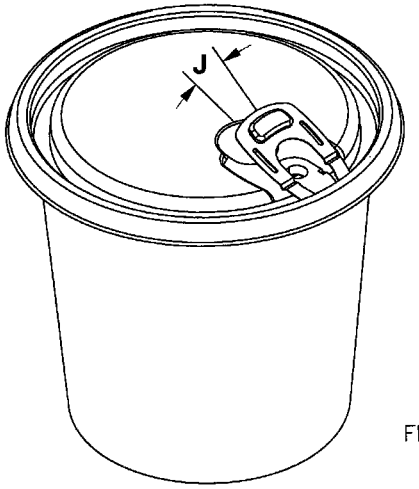
FIG. 2 is a view similar to FIG. 1 but after the container was opened and the pull-tab extends at an upward incline.
Figure 3:
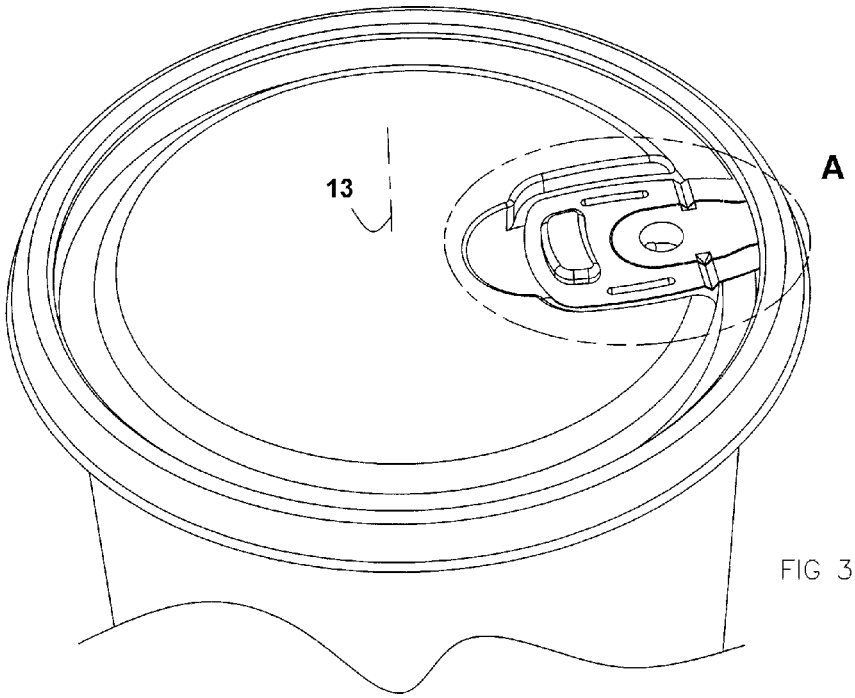
FIG. 3 is an isometric view of the pull-tab assembly before it is opened for the first time.

After the customer grasps the finger grip 57 to separate opposite sides of the through precut channel 40, pulls the tab 18 to lift the lid, and withdraws food, he closes the lid 14 on the base 12. However, the tab 18 will not return to the original position of FIG. 1 because the tab 18 remains at an upward incline J to the lid stacking surface, of at least 10° as shown in FIG. 2. The tab 18 (FIG. 1) is pivotally connected to the lid about a the hinge axis 44 of the hinge 42. The tab 18 has been deformed to pivot up to the position of FIG. 2 wherein the tab 18 extends at an upward incline J of a plurality of degrees. In some cases, it is found that the tab 18 may extend at only a small upward-incline angel J, so the customer may not always recognize that the container has been opened unless the tab 18 extends as a larger incline J.

Applicant prefers to construct the pull-tab assembly as shown in FIG. 4, with a bend arrangement 50 lying radially inward, or forward F (with respect to the vertical axis 13) of the hinge axis 44. The bend arrangement 50 extends perpendicular to an imaginary line 59 that extends forward F and rearward R. The bend arrangement 50 has additional bends 51, 52, and 53 progressively spaced from the hinge axis 44. The bend arrangement 50 urges a forward part 55 of the tab 18, that lies forward of the bends 51-53, to move upward. This urges the forward part 55 to pivot to a steeper upward incline. The three bends 51, 52 and 53 result in a forward-downward wall 60 and a forward-upward wall 62, connected by the bends 51-53. FIG. 10 shows the tab 18 as it extends at a steep upward incline, as a result of bending at the bends 51-53 and bending at the hinge axis 44 of the hinge 42. It becomes more obvious that there has been tampering when the upwardly bent tab 18 cannot return to its original position. The bend arrangement 50 as described above and as seen in FIGS. 1, 2, 3, 4, 5, 11, 12, 13, 14, 15, 17, 18 and 19 extends across the tab 18 from opposite peripheral edges and terminates at or even slightly beyond the precut channel 40 such that when the tab 18 is released from the hold-down 24 the bend arrangement causes increased upward incline as compared with the upward incline without the bend arrangement 50.

Figure 14:
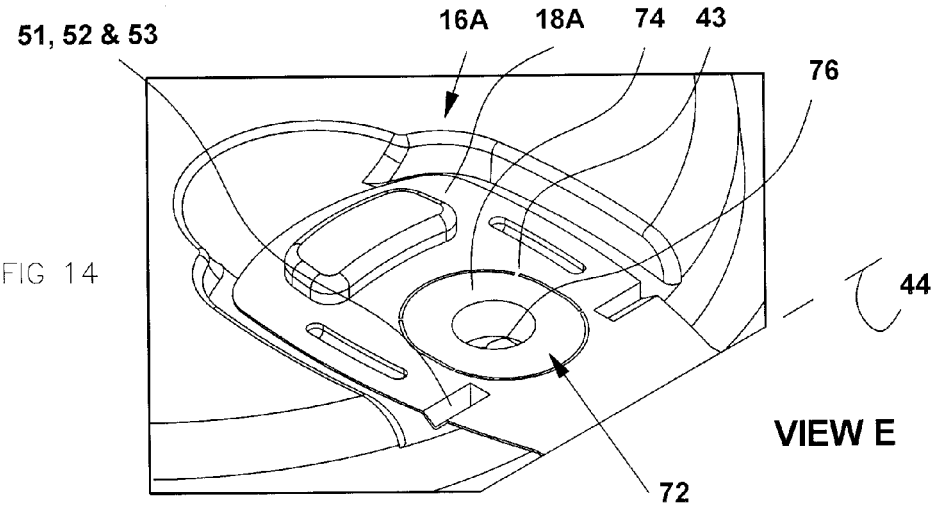
FIG. 14 is an isometric view of a tab assembly wherein the hold-down is of a different shape.
Figure 15:
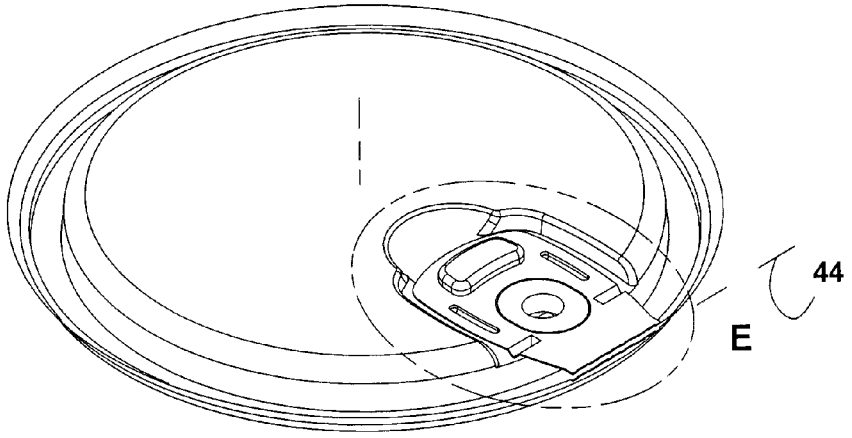
FIG. 15 is an isometric view of a lid that includes the tab assembly of FIG. 14.
Figure 16:
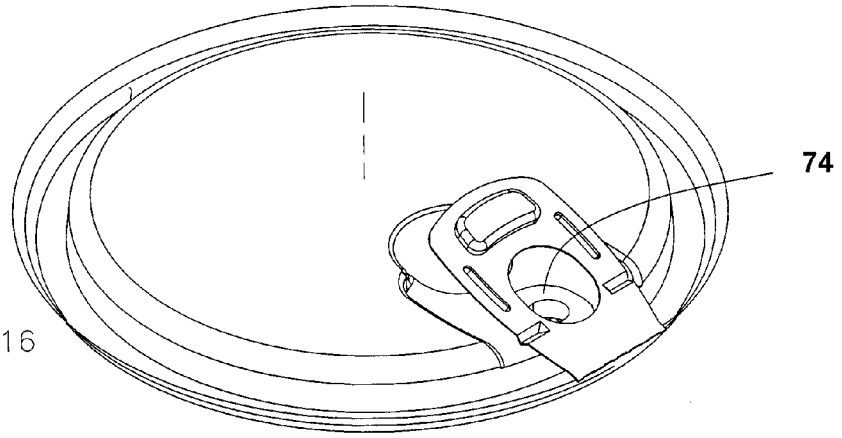
FIG. 16 is a view of FIG. 16 after the tab has broken free of the hold-down and extends at an upward incline.
Figure 17:
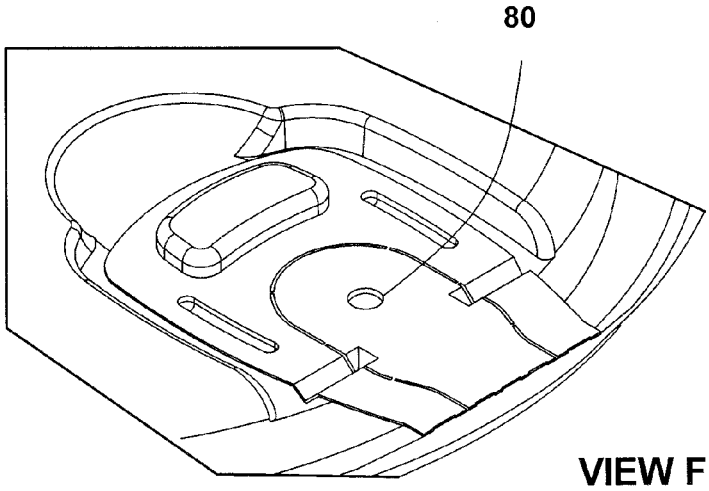
FIGS. 17-19 are isometric views similar to those of FIGS. 14-16, but with the tab being pivotal to lift it while the hold-down is attached to the lid surface by ultrasonic welding or other bonding method.
Figure 18:
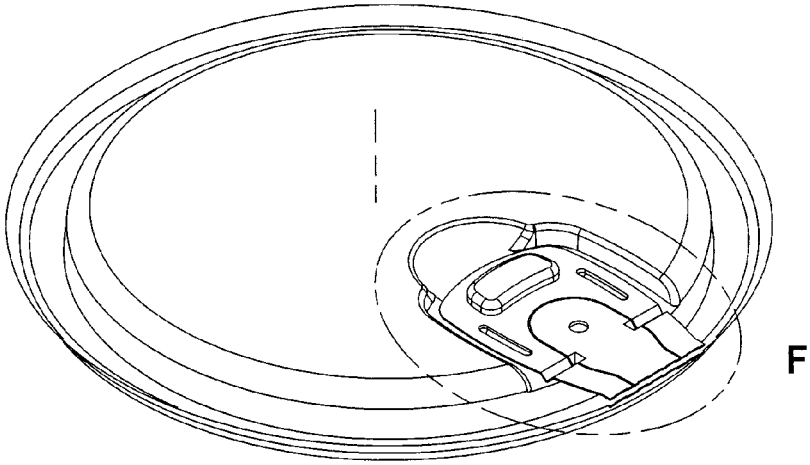
Figure 19:
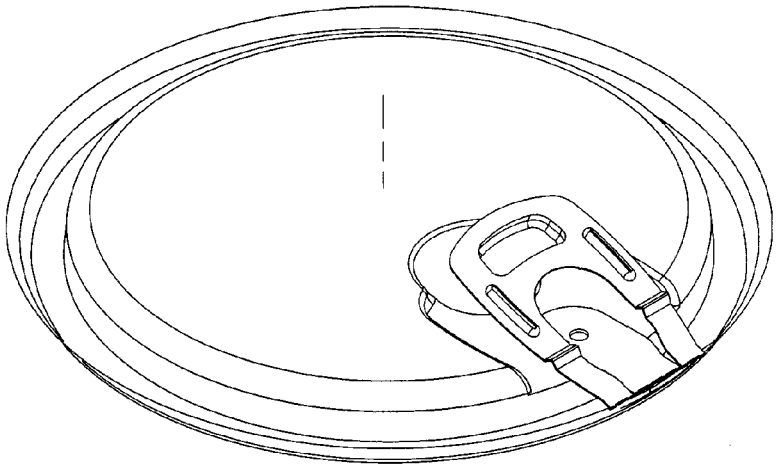

An alternative approach can be used by an unscrupulous person who pulls the tab 18 (FIG. 4) and thereby separates the tab18 from the hold-down 24. Then, that person could use the hold-down 24 to prevent the tab 18 from extending at a steep upward incline. The person can grasp the hold-down 24 near hinge axis 44 where the hold-down 24 joins to the lid 14, and lift the hold-down 24 into the cutout 70 (see FIG. 13) where the hold-down originally lay. To make it more difficult to use the hold-down to prevent the tab from extending at an upward incline, applicant constructs the hold-down as shown in FIG. 14 at 72. FIG. 14 shows that the hold-down includes a small circular top 74 defined by a precut channel 40a with around the enlargement 76 that lies in the undercut recess and is positioned at the middle of the tab 18A of the pull-tab assembly 16A. The small circular top 74 lies facewise against the lid and near to bends 51, 52, and 53, and it cannot be easily lifted from the cutout because it does not extend to the hinge axis 44, although it lies near to the hinge axis 44 (FIG. 15) where the tab 18 connects to the lid.

Figure 20:
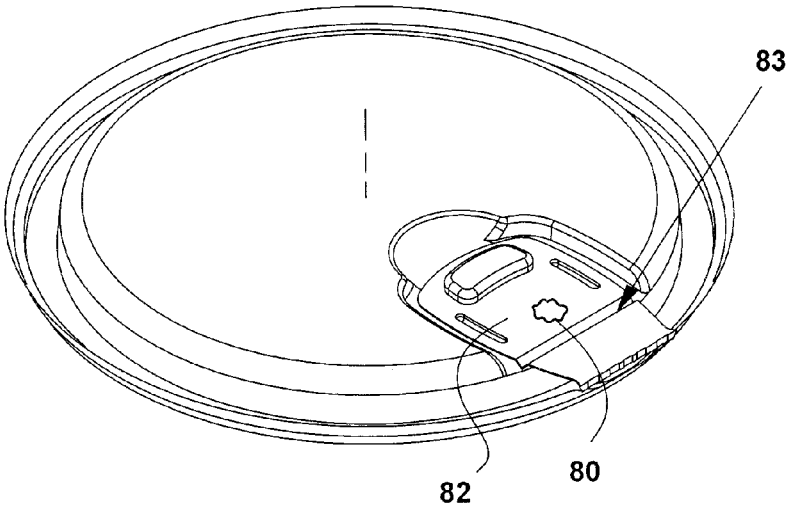
FIGS. 20 and 21 are isometric views of a pull-tab assembly similar to that of FIGS. 14-16, but in which the tab does not have a hold-down and has been welded or bonded directly to the lid.
Figure 21:
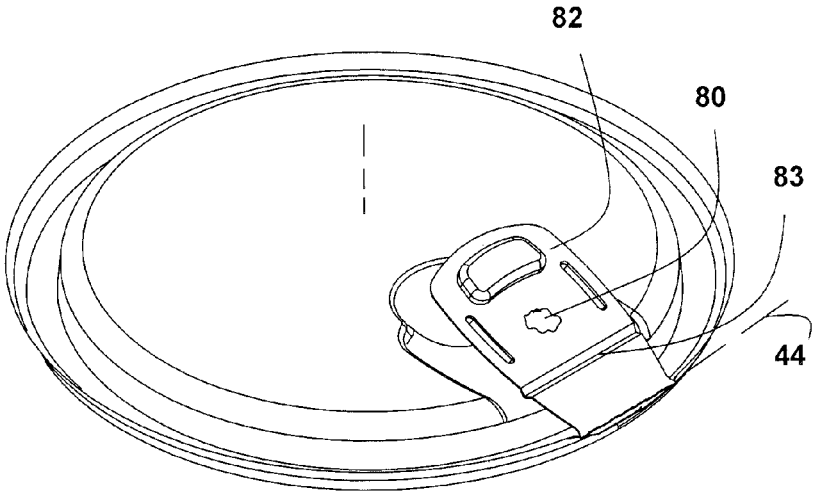

It is also possible to avoid including a separate piece of sheet plastic to form a hold-down. This can be done by welding or otherwise (e.g. adhesive) permanently fastening a spot 80 (FIG. 20) on a tab 82, to the lid. When a customer wants to open the lid, he pulls the tab 82, and thereby breaks the joint formed at the weld spot 80. When the person replaces the lid, the tab 82 will extend at an upward incline at the bend arrangement 83 (FIG. 21) and hinge 44 as shown in FIG. 21 because the spot 80 has been broken loose of the lid.

Figure 7:
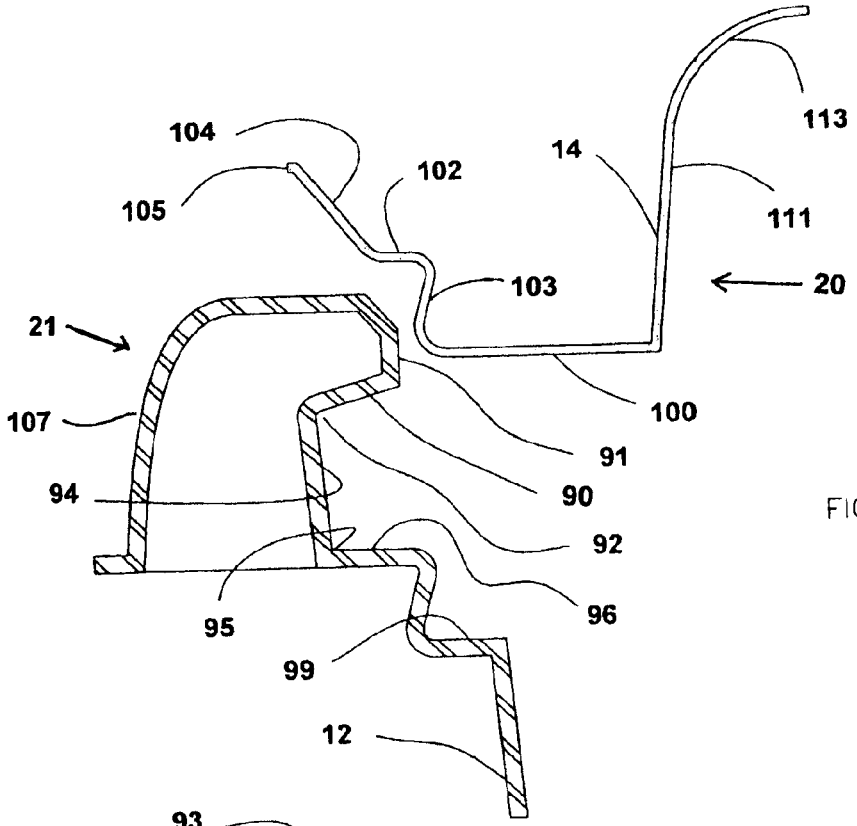
FIG. 7 is a partial sectional view of area C of FIG. 6 prior to attaching the lid to the base.
Figure 8:
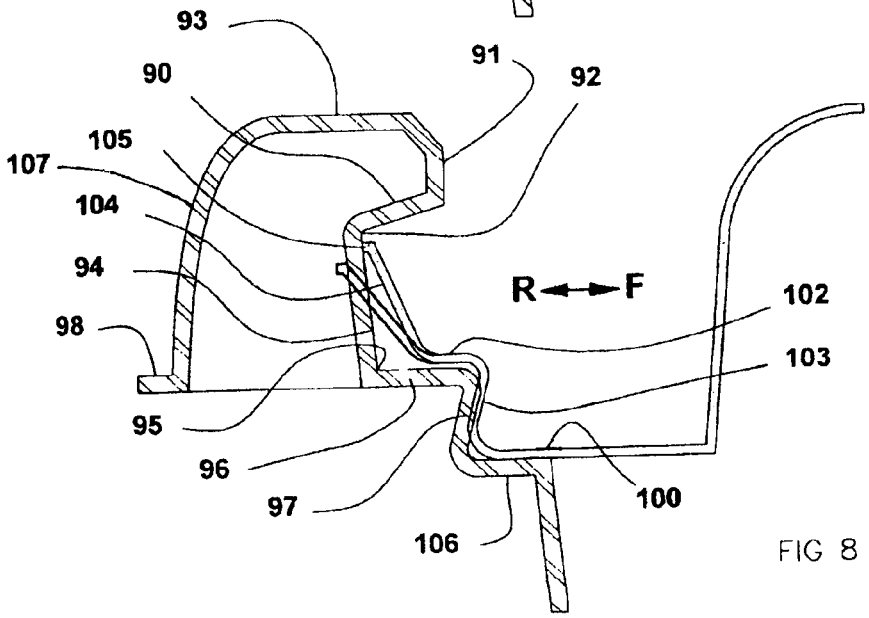
FIG. 8 is view similar to FIG. 7, after the lid is attached to the base.
Figure 9:
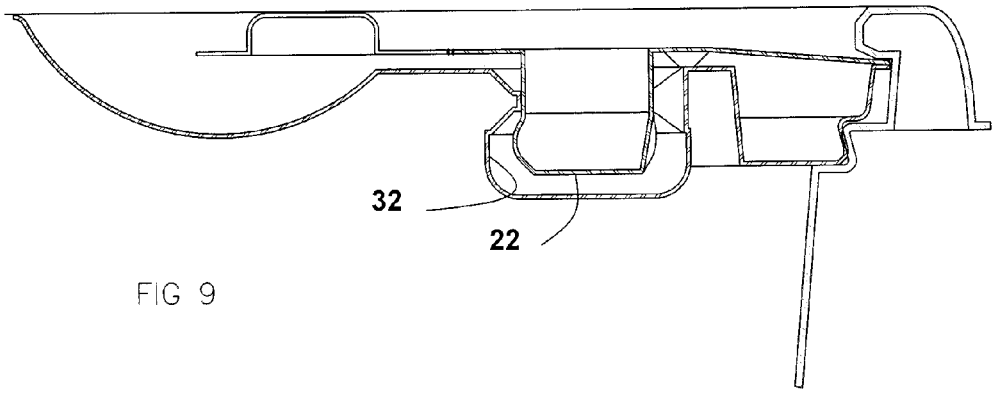
FIG. 9 is an enlarged sectional view of area D of FIG. 6.

FIG. 7 shows a portion of the lid 14 and of the base 12 at a location away from the pull-tab assembly comprising a base rim 21 defining a perimeter of the base 12 and a lid rim 20 defining a perimeter of the lid 14. The base rim 21 and the lid rim 20 engage together to provide sealing and resistance to opening. The base rim 21 has a perimeter fence 91. The base rim 21 also has a primarily horizontal base wall 90 connected by an inside corner 92 (a corner of less than 180°) to a primarily vertical limit wall 94. The limit wall 94 is connected by an inside corner 95 to a primarily horizontal wall 96. The lid rim 20 has horizontal lid nesting walls 100 and 102 (FIG. 8) which rest on base horizontal walls 96, 106. A lid skirt 104 extends at an upward-outward incline towards the inside corner 92 and is protected by the perimeter fence 91 of the base. The lid resists opening because the skirt 104 has a skirt top 105 that engages corner 92 and applies constant pressure of the lid skirt 104 to the limit wall 94. A seal wall 103 of the lid presses against the base perimeter seal 97 with an interference fit to prevent leakage adjacent to the horizontal walls 106, 96 and to support the nesting walls 100, 102 of the lid. This helps in multiple vertical stacking of containers (10). A smooth inclined wall 111 (FIG. 7) projects from the horizontal nesting wall 100 and a large smooth convex curve 113 prevents the consumer from grasping the inclined wall 104 or 111 to open the lid. The base rim 21 has a horizontal surface 93 (FIG. 8) adjacent to the perimeter fence 91 and spaced from the horizontal skirt 98. The base rim 21 has an outer portion extending from the horizontal surface 93 which is an outside perimeter wall 107 extending downwardly and having a horizontal skirt 98 at its lower termination.

Figure 22:
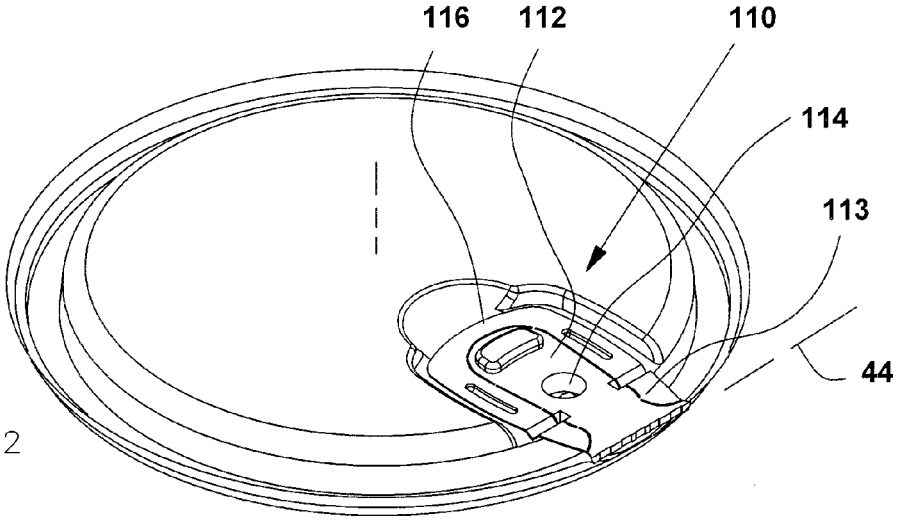
FIGS. 22-24 are isometric views of a pull-tab assembly in which the tab is protected by a tab protector. The protector is connected to the pull-tab by frangible joints and can be detached to access the tab.
Figure 23:
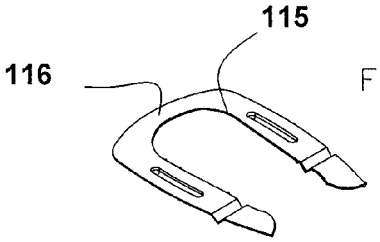
Figure 24:
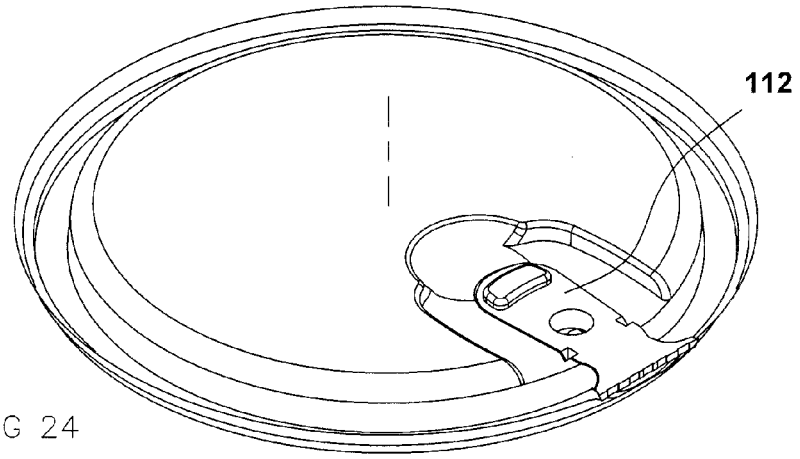
Figure 28:
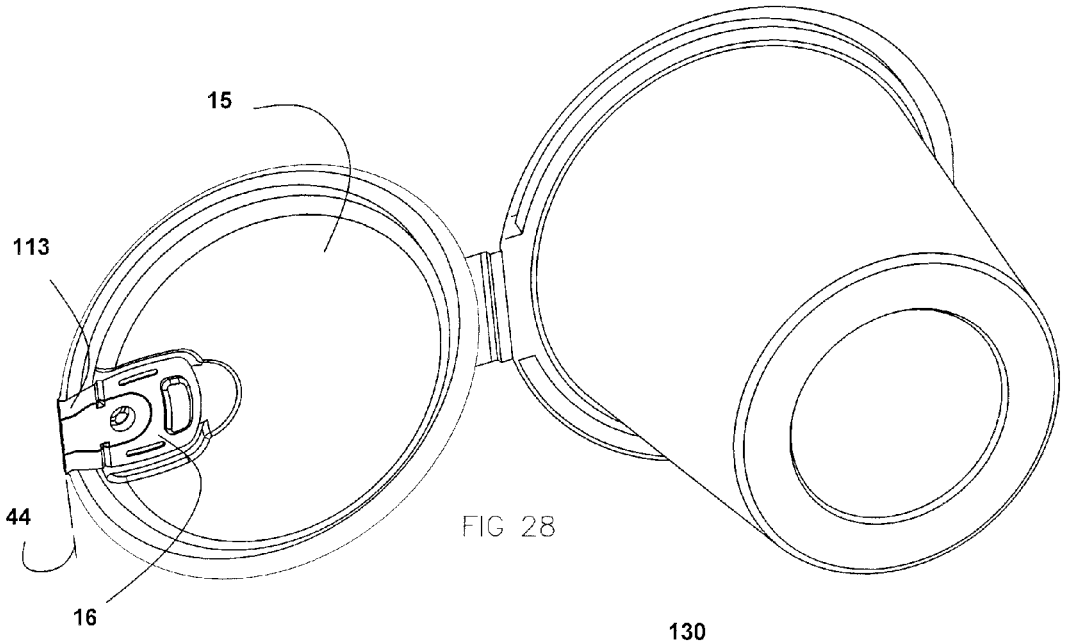
FIG. 28 is an isometric bottom view of a hinged container in which the tab is stowed and the container is ready for receiving products.

FIG. 22 shows a pull-tab assembly 110 that includes a tab 112 held down to the lid by an enlargement 114 that fits into an undercut hole. A tab protector 116 (FIG. 22) attaches to the pull-tab 112 with small frangible joints 115 that are similar to joints 43, 70 of FIG. 4. A through precut channel 113 separates the pull-tab 112 and the rear end of the tab protector 116. Upon severing the frangible joints 115, the consumer can access the center pull-tab 112 and pull it upward to open the container.

FIGS. 25-28 show a container 12 that connects to the lid by the hinge 118 whereas the pull-tab assembly 16 (FIG. 28) is folded downward and facewise to the upper flat stacking surface 15 of the lid. A through precut channel 113 extends adjacent to the folding hinge axis 44, which is formed by a single sheet of plastic. The lid 14 (FIG. 25) can be folded or torn apart from the container 12 by a frangible joint 117 (FIG. 27) for convenience and to avoid dangling of the lid once the pull-tab is pulled open.

Figure 29:
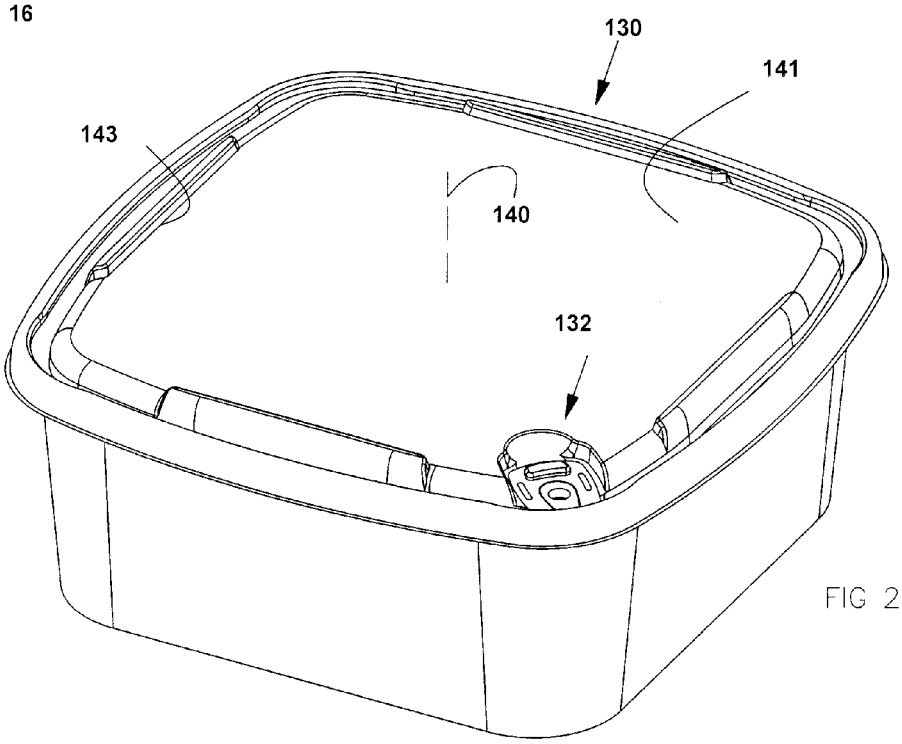
FIG. 29 is an isometric view of a container of rectangular shape which has the pull-tab assembly at the corner of the container similar to that of FIG. 1.

FIG. 29 shows a container 130 of primarily rectangular or square shape, with four sides joined at right angles. The container includes a center axis 140, and a single pull-tab assembly 132 of one of the types described earlier herein, at only one of the four corners. Applicant shows recessed (or protruding) stacking projectors 143 projecting from the lid surface 141 to allow vertical stacking and nesting of the bottom container.

FIG. 30 shows the plan top view of the square container with a mechanical lock 142 between the corners with the lid sidewall 138 and the container sidewall 139 to retain the lid and base together when the consumer tries to pull the base rim away from the center axis 140.

FIG. 31 shows a container sealed by an interference fit of a perimeter seal 134 of the lid wall and a perimeter seal wall 135 of the base to provide an airtight or contamination free entry to the container. A perimeter smooth inclined wall 136 of the lid projects from the horizontal wall and a large radius of curvature (at least 10% of the container radius at the bottom) smooth convex lid wall 137 prevents the consumer from gripping the inclined wall to open the lid.

Thus, the invention provides improvements to tamper-evident containers. To assure that the tab extends at a considerable upward incline after the container is opened and closed, the tab is provided with one or more additional bends (51-53), the bend arrangement (50) at locations spaced forward from the hinge axis where the tab pivotally connects to the lid. A hold-down (72) that holds down the tab prior to its first lifting can include a small diameter sheet plastic top (74) lying around the projection (76) and flat (facewise) against the lid. This hold-down is close to the hinge (42) and replaces an elongated strip (24), so a person cannot easily pull up the hold-down. The tab assembly can include a tab protector (116) that lies on top of the tab, so a person must first lift the protector before pulling the tab. The lid rim 20 includes a skirt (104) that abuts an inside corner (92) formed in the base rim 21 and the vertical limit wall (94), to resist opening the lid without use of the pull-tab. In a rectangular container, the pull-tab lies only at one of the corners of the container. A mechanical lock (142) between the corners and the skirt (104) holds the container and lid together.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A container for providing evidence of tampering, comprising:

a base;

a lid having a two component pull-tab assembly, said lid engageable with the base, said lid comprising an outer lid rim and a inner removable lid cover, said inner removable lid cover having a lockdown recess, and said two component pull-tab assembly connected to the outer lid rim;

wherein said two component pull-tab assembly comprises an outer frangible pull-tab, and an inner hold-down tab;

wherein the outer frangible pull-tab and the inner hold-down tab define a channel between the outer frangible pull-tab and the inner hold-down tab;

wherein there is at least one frangible connection joint in the channel connecting the outer frangible pull-tab and the inner hold-down tab;

wherein the outer frangible pull-tab further comprises a first rear connecting joint that defines a first terminus of the channel, and a second rear connecting joint that defines a second terminus of the channel;

wherein the first rear connecting joint and the second rear connecting joint have a foldable hinge, and wherein the first rear connecting joint and the second rear connecting joint are connected to the outer lid rim; and, wherein the foldable hinge comprises at least one bend, wherein the bend positions the outer frangible pull-tab into a steep upward incline when the frangible connection joint in the channel is broken, whereby the upwardly inclined outer frangible pull-tab provides a user with visual evidence of tampering.

2. The container described in claim 1 wherein: said lid has a seal wall that presses against a base perimeter wall with an interference fit adjacent to a horizontal wall to support a nesting wall.

3. The container described in claim 1, wherein: said container is of rectangular shape with said base and lid each having four sides that form four corners; said two-component pull-tab assembly lies in one of said corners of said lid.

4. The container described in claim 1, wherein: said container is of rectangular shape with said base and lid each having four sides that fork four corners; a mechanical lock lying between each pair of said corners, each mechanical lock including a lid sidewall and container sidewall that hold the lid and container together.

5. The container of claim 1 wherein the lid has a stacking surface having a stacking recess and the two-component pull-tab assembly is configured to fit in the stacking recess.

6. The container of claim 1 wherein the bend comprises three bends, a first bend, a second bend, and a third bend, the first and third bends are in a closed resiliency and the second bend is in an open resiliency in a stowed position.

7. The container of claim 1 wherein the lid and the two-component pull-tab assembly are formed from the same thickness of plastic sheet by thermoforming and the bend is a set of bends of the plastic sheet.

8. The container of claim 1 wherein the base comprises a base rim, said base rim having an outside perimeter wall.

9. The container of claim 1, wherein the container is round.

10. The container of claim 1, wherein the container is rectangular.

11. The container of claim 1, wherein the container is formed from a plastic sheet.

12. The container of claim 1, wherein the lid is formed from a plastic sheet.

13. The container of claim 1, wherein the container is a hinged container.

14. The container of claim 1, wherein the container is unhinged where the lid is separate from the base.

15. The container of claim 8, wherein the two-component pull tab assembly is within the circumference of the outside perimeter wall of the base.

16. The container of claim 1, where in the foldable hinge is confined within the vertical limit wall of the base in a stowed position.

17. A container for providing evidence of tampering, comprising:

a base:

a lid having a two component pull-tab assembly, said lid engageable with the base, said lid comprising an outer lid rim and a inner removable lid cover, said inner removable lid cover having a lockdown recess, and said two component pull-tab assembly connected to the outer lid rim:

wherein said two component pull-tab assembly comprises an outer frangible pull-tab, and an inner hold-down tab:

wherein the outer frangible pull-tab and the inner hold-down tab define a channel between the outer frangible pull-tab and the inner hold-down tab:

wherein there is at least one frangible connection joint in the channel connecting the outer frangible pull-tab and the inner hold-down tab:

wherein the outer frangible pull-tab further comprises a first rear connecting joint that defines a first terminus of the channel, and a second rear connecting joint that defined a second terminus of the channel:

wherein the first rear connecting joint and the second rear connecting joint have a foldable hinge, and wherein the first rear connecting joint and the second rear connecting joint are connected to the outer lid rim: and wherein the foldable hinge comprises at least one bend, wherein the bend positions the outer frangible pull-tab into a steep upward incline when the frangible connection joint in the channel is broken, whereby the upwardly inclined outer frangible pull-tab provides a user with visual evidence of tampering, wherein:

said base has a rim, said base rim has a vertically-extending limit wall, an overhang wall joined to a top of said limit wall by a first inside corner and extending forward of said limit wall, and a primarily horizontally-extending base wall extending forward to said limit wall and joined to said limit wall by an inside corner; and said lid has a nesting wall that lies on a horizontally-extending base wall and said lid has a skirt that extends at an upward and rearward incline and that has a skirt top that lies at said first inside corner.

18. A container for providing evidence of tampering. comprising:

a base:

a lid having a two component pull-tab assembly. said lid engageable with the base, said lid comprising an outer lid rim and a inner removable lid cover, said inner removable lid cover having a lockdown recess. and said two component pull-tab assembly connected to the outer lid rim:

wherein said two component pull-tab assembly comprises an outer frangible pull-tab, and an inner hold-down tab:

wherein the outer frangible pull-tab and the inner hold-down tab define a channel between the outer frangible pull-tab and the inner hold-down tab:

wherein there is at least one frangible connection joint in the channel connecting the outer frangible pull-tab and the inner hold-down tab:

wherein the outer frangible pull-tab further comprises a first rear connecting joint that defines a first terminus of the channel. and a second rear connecting joint that defines a second terminus of the channel:

wherein the first rear connecting joint and the second rear connecting joint have a foldable hinge, and wherein the first rear connecting joint and the second rear connecting joint are connected to the outer lid rim: and, wherein the foldable hinge comprises at least one bend, wherein the bend positions the outer frangible pull-tab into a steep upward incline when the frangible connection joint in the channel is broken, whereby the upwardly inclined outer frangible pull-tab provides a user with visual evidence of tampering, wherein the lid has a seal wall that presses against a perimeter seal wall of the base with an interference fit, and below the perimeter seal wall is a horizontal wall upon which is a horizontal lid supporting wall.

* * * * *